US011495886B2

(12) United States Patent
Hong et al.

(10) Patent No.: US 11,495,886 B2
(45) Date of Patent: Nov. 8, 2022

(54) CAVITY-BACKED SPIRAL ANTENNA WITH PERTURBATION ELEMENTS

(71) Applicant: The Board of Trustees of the University of Alabama, Tuscaloosa, AL (US)

(72) Inventors: Yang-Ki Hong, Tuscaloosa, AL (US); Woncheol Lee, Tuscaloosa, AL (US); Katelyn Isbell, Tuscaloosa, AL (US); Nikolaus Luhrs, Crossville, TN (US)

(73) Assignee: The Board of Trustees of the University of Alabama, Tuscaloosa, AL (US)

( * ) Notice: Subject to any disclaimer, the term of this patent is extended or adjusted under 35 U.S.C. 154(b) by 239 days.

(21) Appl. No.: 16/235,674

(22) Filed: Dec. 28, 2018

(65) Prior Publication Data

US 2019/0207317 A1 Jul. 4, 2019

Related U.S. Application Data

(60) Provisional application No. 62/613,640, filed on Jan. 4, 2018.

(51) Int. Cl.
*H01Q 9/27* (2006.01)
*H01Q 5/357* (2015.01)
(Continued)

(52) U.S. Cl.
CPC ..... *H01Q 9/27* (2013.01); *H01Q 1/288* (2013.01); *H01Q 1/362* (2013.01); *H01Q 1/48* (2013.01); *H01Q 5/357* (2015.01)

(58) Field of Classification Search
CPC H01Q 9/27; H01Q 1/288; H01Q 1/48; H01Q 5/357; H01Q 1/362
See application file for complete search history.

(56) References Cited

U.S. PATENT DOCUMENTS 3,555,554 A * 1/1971 Kuo ..... H01Q 9/27 343/895
4,015,264 A * 3/1977 Koerner ..... H01Q 9/27 343/725

(Continued)

FOREIGN PATENT DOCUMENTS

CN 101872895 A * 10/2010 ..... H01Q 1/36
JP 2002094322 A * 3/2002 ..... H01Q 1/38
JP 3772577 B2 * 5/2006 ..... H01Q 11/08

OTHER PUBLICATIONS

Kim et al., "Cavity-backed Two-arm Spiral Antenna with a Ring-shaped Absorber for Partial Discharge Diagnosis", J Electr Eng Technol vol. 8, No. 4: 856-862, 2013 (Year: 2013).*

(Continued)

*Primary Examiner* — Dimary S Lopez Cruz
*Assistant Examiner* — Bamidele A Jegede
(74) *Attorney, Agent, or Firm* — Meunier Carlin & Curfman LLC

(57) ABSTRACT

Satellites require a suitable antenna for line of sight microwave communication with the ground. Disclosed here is an Archimedean spiral antenna backed by a copper cavity containing quadruple conical perturbations. The antenna meets the required size, mass, transmitting power, bandwidth, and circular polarization for a satellite (e.g., CubeSat) environment while providing immunity to the mounting position.

10 Claims, 14 Drawing Sheets

(51) Int. Cl.

| | |
|---|---|
| ***H01Q 1/36*** | (2006.01) |
| ***H01Q 1/28*** | (2006.01) |
| ***H01Q 1/48*** | (2006.01) |

(56) References Cited

U.S. PATENT DOCUMENTS

| | | | | |
|---|---|---|---|---|
| 4,658,262 | A * | 4/1987 | DuHamel | H01Q 11/10 343/792.5 |
| 5,170,175 | A * | 12/1992 | Kobus | H01Q 1/36 343/700 MS |
| 5,313,216 | A * | 5/1994 | Wang | H01Q 9/27 343/700 MS |
| 5,623,271 | A * | 4/1997 | Ponnapalli | H01Q 1/22 343/846 |
| 5,712,647 | A * | 1/1998 | Shively | H01Q 1/36 343/700 MS |
| 6,219,006 | B1 * | 4/2001 | Rudish | H01Q 1/36 343/700 MS |
| 6,335,710 | B1 * | 1/2002 | Falk | H01Q 1/36 343/753 |
| 6,853,351 | B1 * | 2/2005 | Mohuchy | H01Q 9/27 343/700 MS |
| 8,749,451 | B1 * | 6/2014 | Zamarron | H01Q 1/36 343/846 |
| 8,847,846 | B1 * | 9/2014 | Diaz | H01Q 1/36 343/895 |
| 8,994,607 | B1 * | 3/2015 | Lin | H01Q 1/36 343/868 |
| 2002/0122009 | A1 * | 9/2002 | Winebrand | H01Q 9/27 343/767 |
| 2003/0210205 | A1 * | 11/2003 | Cencich | H01Q 1/362 343/895 |
| 2005/0243013 | A1 * | 11/2005 | Neel | H01Q 1/38 343/895 |
| 2008/0303714 | A1 * | 12/2008 | Ezal | G01S 3/32 342/357.22 |
| 2009/0289868 | A1 * | 11/2009 | Granger | H01Q 1/48 343/848 |
| 2010/0066624 | A1 * | 3/2010 | Masuda | H01Q 9/27 343/787 |
| 2010/0134371 | A1 * | 6/2010 | Worl | H01Q 11/105 343/792.5 |
| 2011/0234471 | A1 * | 9/2011 | Tanabe | H01Q 17/00 343/895 |
| 2012/0062438 | A1 * | 3/2012 | Tanabe | H01Q 1/38 343/834 |
| 2012/0229363 | A1 * | 9/2012 | Webb | H01Q 1/38 343/895 |
| 2013/0249762 | A1 * | 9/2013 | Grelier | H01Q 19/18 343/834 |
| 2014/0378813 | A1 * | 12/2014 | Saroka | A61B 5/0507 600/407 |
| 2015/0295324 | A1 * | 10/2015 | Kletsov | H01Q 1/38 343/767 |
| 2016/0043464 | A1 * | 2/2016 | Grandfield | H01Q 1/36 343/848 |
| 2016/0254842 | A1 * | 9/2016 | Hong | H04B 5/0081 343/867 |
| 2017/0162944 | A1 * | 6/2017 | Hao | H01Q 15/0046 |
| 2017/0338551 | A1 * | 11/2017 | Rahman | H01Q 7/00 |
| 2018/0212318 | A1 * | 7/2018 | Balanis | H01Q 9/27 |
| 2020/0044356 | A1 * | 2/2020 | Mallegol | H01Q 17/00 |

OTHER PUBLICATIONS

Huang et al., "A New Spiral Antenna with Improved Axial Ratio and Shorted Arm Length", Progress In Electromagnetics Research C, vol. 46, 83-89, 2014 (Year: 2014).*

AbdiRahman et al., "Archimedean Spiral Antenna on Moveable Ground Plane for UWB Applications", ARPN Journal of Engineering and Applied Sciences, vol. 10, No. 4, Mar. 2015 (Year: 2015).*

Chen et al., "Modal Resistance of Spiral Antenna", Journal of Electromagnetic Analysis and Applications, 2013, 5, 223-228 (Year: 2013).*

M. Swartwout, "The first one hundred CubeSats: a statistical look," Journal of Small Satellites., vol. 2, pp. 213-233, 2014.

S. X. Ta and I. Park, "Low-Profile Broadband Circularly Polarized Patch Antenna Using Metasurface," IEEE Transactions on Antennas and Propagation, vol. 63, No. 12, pp. 5929-5934, 2015.

D. Feng, H. Zhai, L. Xi, S. Yang, K. Zhang, and D. Yang, "A Broadband Low-Profile Circular Polarized Antenna on an AMC Reflector," IEEE Antennas and Wireless Propagation Letters, 2017, in press, 2840-2843.

Y.-J. Hu, W.-P. Ding, W-M. Ni, and W.-Q. Cao, "Broadband Circularly Polarized Cavity-Backed Slot Antenna Array with Four Linearly Polarized Disks Located in a Single Circular Slot," IEEE Antennas and Wireless Propagation Letters, vol. 11, pp. 496-499, 2012.

A. Siahcheshm, J. Nourinia, Ch. Ghobadi, M. Karamirad, and B. Mohammadi, "A Broadband Circularly Polarized Cavity-backed Archimedean Spiral Array Antenna for C-band Applications," International Journal of Electronics and Communications, vol. 81, pp. 218-226, 2017.

F. E. Tubbal, R. Raad, and K. W. Chin, "A Survey and Study of Planar Antennas for Pico-Satellites," IEEE Access, vol. 3, pp. 2590-2612, 2015.

S. Gao, Q. Luo, and F. Zhu, "Introduction to Circularly Polarized Antennas" in Circularly Polarized Antennas, United Kingdom: John Wiley & Sons Ltd, 2014, pp. 1-25.

General Mission Analysis Tool [Open Source Software]. 2 pages. Available: http://gmat.gsfc.nasa.gov.

R. R. Bate, D. D. Mueller, and J. E. White, Fundamentals of Astrodynamics. New York: Dover Publications, 1971, pp. 33-34.

T. Soler and D. W. Eisemann, "Determination of Look Angles to Geostationary Communication Satellites." J. Surveying Engineering, vol. 120, No. 3, pp. 115-127, Aug. 1994.

A. Atayero, M. K. Luka, and A. A. Alatishe, "Satellite Link Design: A Tutorial," Int. J. of Elect. and Comput. Sci., vol. 11, No. 4, Aug. 2011.

"GATR 1.2 Meter High-bandwidth, Backpackable Antenna." Internet http://www.gatr.com/products/1-2-antenna-system, 2016 [Apr. 20, 2017].

C. A. Balanis, Antenna Theory: Analysis and Design, 3rd edition. Hoboken, New Jerksey: John Wiley & Sons, 2005, pp. 94-96.

H. Nakano, T. Igarashi, H. Oyanagi, Y. Iitsuka, and J. Yamauchi, "Unbalanced-Mode Spiral Antenna Backed by an Extremely Shallow Cavity," IEEE Trans. Antennas Propag., vol. 57, No. 6, pp. 1625-1633, Jun. 2009.

R. W. Klopfenstein. "A Transmission Line Taper of Improved Design." Proc. IRE, vol. 44, No. 1, pp. 31-35, 1956.

D. M. Pozar, "Impedance Matching and Tuning" in Microwave Engineering, 4th ed., Danvers, MA: John Wiley & Sons, Inc., 2012, p. 265.

S. A. P. Rizvi and R. A. A. Khan, "Klopfenstein tapered 2-18 GHz microstrip balun," in Proc. IBCAST, Islamabad, Pakistan, 2012, pp. 359-362.

E. D. Caswell, "Design and Analysis of Star Spiral with Application to Wideband Arrays with Variable Element Sizes." Ph.D. dissertation, Dept. Elect. Eng., Virginia Polytechnic Institute and State University, Blacksburg, VA, USA, 2001.

N. Jastram and D. S. Filipovic, "Design of Cavity Backed 15:1 Bandwidth Two Arm Spiral Helix Antenna," in IEEE/ACES International Conference on Wireless Information Technology and Systems and Applied Computational Electromagnetics, Honolulu, HI, 2016, pp. 1-2.

H. Nakano, H. Oyanagi, and J. Yamauchi, "Extremely Low-Profile Wideband Spiral Antenna with Absorbing Material," in 3rd European Conference on Antennas and Propagation, Berlin, 2009, pp. 1029-1032.

F. Ding, F. Zhang, and Y. Zhang, "The Broadband Composite Structure Spiral Antenna with a Ladder-Shaped Backed-Cavity,"

(56) References Cited

OTHER PUBLICATIONS 2011 4th IEEE International Symposium on Microwave, Antenna, Propagation and EMC Technologies for Wireless Communications, Beijing, 2011, pp. 120-123.

* cited by examiner

CAVITY-BACKED SPIRAL ANTENNA WITH PERTURBATION ELEMENTS

CROSS-REFERENCE TO RELATED APPLICATION

This application claims priority to and benefit of U.S. provisional patent application Ser. No. 62/613,640 filed Jan. 4, 2018, which is fully incorporated by reference and made a part hereof.

FIELD

The present disclosure relates to antennas and more specifically, to a cavity-backed spiral antenna for satellite applications that has perturbation elements within the cavity to improve performance.

BACKGROUND

Since the development of the first CubeSat in 1999, there have been great advancements in the design, construction, and deployment of amateur nano-satellites due to their simplicity and low cost. However, from 2000 to 2012, 47% of CubeSat failure was attributed to loss of contact [1], revealing the need for further development in communication and antenna systems.

CubeSat antenna development faces several challenges, including restrictions on size, mass, and transmitting power, while demanding wide bandwidth and circular polarization. Planar antennas have been designed as alternatives to the deployable monopole antennas common for small satellites, as they eliminate the possibility of mechanical failure and allow for low profile. Frequently-used planar antennas include slot and patch antennas, but these fail to achieve sufficient circular polarization bandwidth for satellite antennas [2].

In order to meet aforementioned antenna characteristics, other antenna designs have been proposed [15-18]. A patch antenna with metasurface [15] and a dipole antenna with artificial magnetic conductor (AMC) [16] are low profile and provide broadband. However, the patch antenna showed a narrow bandwidth of low axial ratio (AR) below 3 dB (3-dB AR bandwidth) at 1.45 GHz (23.4%) and 0.72 GHz (44.7%). A cavity-backed slot antenna showed a broader 3-dB AR bandwidth of 3 GHz (54.5%) [17], but the antenna gain fluctuated from 6 dBic to 9.9 dBic in the operating frequency. A cavity-backed spiral antenna array showed a similar 3-dB AR bandwidth and relatively stable antenna gain [18]. However, the antenna has a large area of $1.29\lambda_L \times 1.5\lambda_L$, where $\lambda_L$ is the free space wavelength at the lowest frequency.

The spiral antenna is a good candidate for CubeSat satellite applications because it is frequency independent and characteristically circularly polarized [3]. A need, therefore, exists for an improved spiral antenna design to meet the requirements for communication in a CubeSat satellite application.

SUMMARY

Accordingly, disclosed herein is an antenna design to achieve broad bandwidth, high antenna gain, and circular polarization with low-profile. The antenna design embraces a cavity-backed Archimedean spiral antenna with quadruple conical perturbations (CBASA-QCP), which consists of an Archimedean spiral antenna (ASA) backed by a cavity having four conical perturbation elements (i.e., cones). The ASA typically has two radiator arms with a typical number of turns (n)=5, a typical radiator width (w)=0.7 mm, and a typical spacing (s)=1 mm. The ASA can be placed on a ROGERS DUROID™ 5880 substrate, which has a diameter of 40 millimeters (mm), a thickness of 0.787 mm, and a relative dielectric constant ($\varepsilon_r$) of 2.2. The backing cavity typically consists of four conical perturbations with a possible cone height ($h_{cone}$)=2 mm and cone diameter ($D_{cone}$)=8 mm for a cavity height ($h_{cav}$)=6 mm. This antenna design allows for a wide −10-dB impedance bandwidth (e.g., of greater than 124.3% over 7-30 GHz), 3-dB axial ratio bandwidth (e.g., of 107.2% over 8-26.5 GHz), 3-dB gain bandwidth (e.g., of 72% over 7-15 GHz and of 28.6% over 19.7-26.5 GHz), and a high peak realized gain (RG) (e.g., of 10.7 dBic) at boresight.

Thus, in one aspect, the present disclosure embraces an antenna, consisting of an antenna element having two conductive arms disposed on a circular substrate wherein each conductive arm begins at one side of a feed port and traces a spiral for a plurality of revolutions. The antenna also includes a cylindrical cavity comprising a cavity base and a cavity wall, wherein the cavity wall defines an opening that substantially matches a diameter of the circular substrate. The cylindrical cavity is positioned behind the antenna element so that the substrate covers the opening formed by the cavity wall. One or more perturbation elements are disposed or formed on the cavity base. Each perturbation element has an element base that is flush with the cavity base and an element top at a height above the cavity base. The height of each element top is between the cavity base and the circular substrate.

In an example embodiment of the antenna, the spiral is an Archimedean spiral.

In another example embodiment of the antenna, each perturbation element is a cone, a cylinder, or a cone with a flat top. In these embodiments, aspects of the antenna's performance may be affected by a shape, a size, a number and/or an arrangement of the perturbation elements. For example, the performance affected may include a bandwidth, an axial ratio, or a gain measured at the feed point of the antenna.

In another example embodiment of the antenna, each conductive arm may be a conducting polymer, metal, or metal alloy.

The foregoing illustrative summary, as well as other exemplary objectives and/or advantages of the disclosure, and the manner in which the same are accomplished, are further explained within the following detailed description and its accompanying drawings.

DETAILED DESCRIPTION

Link Scenario

The design of the antenna requires a knowledge of the link and power budges for communication in the satellite (e.g., CubeSat) environment. Accordingly, a link scenario is first determined.

Figure 1B:
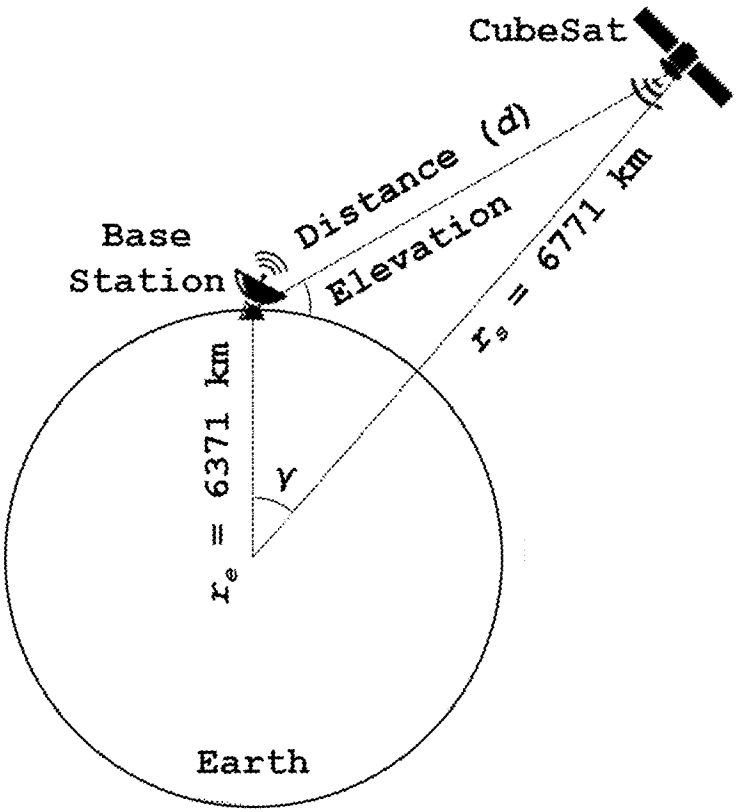
FIG. 1B is a schematic view of a satellite communication link scenario.
Figure 1A:
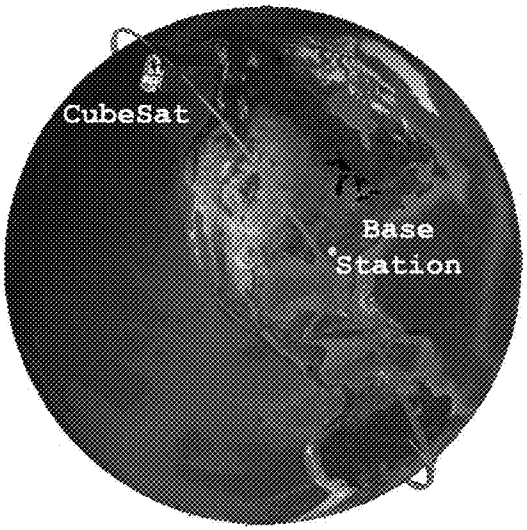
FIG. 1A illustrates a perspective view of an orbital path of a satellite.

The purpose of the link scenario is to accurately depict all visible encounters between the satellite and ground station for the CubeSat's orbit around the earth. Using NASA's open-source General Mission Analysis Tool (GMAT) [4], a circular Low Earth Orbit (LEO) was simulated at altitude of 400 km with a semi-major axis of 6771 km, an eccentricity of approximately 0, an inclination of 51.3°, and a longitude of ascending node of 170.1347°, as shown in FIG. 1A and FIG. 1B. The ground station was chosen to be located in Tuscaloosa, Ala., U.S.A with an elevation of 0 km. The following equations were used to determine the average velocity ($v_{orbit}$) and period (T) of the CubeSat in orbit [5]:

$$v_{orbit} = \sqrt{G \cdot M / r_s},$$

$$T = 2\pi\sqrt[3]{r_s^2} \Big/ \sqrt{G \cdot M},$$

where G is the gravitational constant, M is the mass of Earth, and $r_s$ is the distance from the center of the Earth to the satellite. The standard mass of the CubeSat (3 kg) was used. From these calculations, $v_{orbit}$ is 7.676 km/s and T is 5541 seconds, meaning the CubeSat completes 15.59 orbits per day.

The satellite communication link requires Line-of-Sight (LoS) communication. Therefore, visibility calculations were performed using the following trigonometric equations [6]:

$$d = r_s\sqrt{1+(r_e/r_s)^2-2(r_e/r_s)\cos(\gamma)},$$

$$\gamma \leq \cos^{-1}(r_e/r_s),$$

where d is the distance between the satellite and ground station, γ is the angle between the satellite sub-point and ground station, $r_e$ is the radius of the earth. With a minimum elevation of 20°, γ is limited to a maximum of 6.55°, which allows us to determine the maximum d using above equations. Using the simulation of the CubeSat's orbit, the range d was found over a period of 24 hours and the minimum d was determined. Therefore, LoS communication is constrained to d values between 433 km and 1,000 km.

Required Antenna Performance

A satellite link budget accounts for propagation losses in addition to losses caused by polarization mismatch [7, 9]. The basic link budget can be calculated using the Friis equation:

$$\frac{P_r}{P_t} = G_t G_r \left(\frac{\lambda}{4\pi d}\right)^2 (1-|\Gamma_t|^2)(1-|\Gamma_r|^2)|a_t \cdot a_r^*|^2$$

where $P_r$ is the receiving antenna power, $P_t$ is the transmitting antenna power, $G_t$ is the transmitting antenna gain, $G_r$ is the receiving antenna gain, d is the distance between the receiving and transmitting antennas, λ is the wavelength of the target frequency, $\Gamma_t$ is the reflection coefficient of the transmitting antenna, $\Gamma_r$ is the reflection coefficient of the receiving

TABLE I

LINK BUDGET FOR A CUBESAT ANTENNA

| | 8 GHz (X-band) | 11.2 GHz (Ku-band) |
|---|---|---|
| Input Parameters | | |
| Transmitting power (Satellite) | 37 dBm | 37 dBm |
| Max. communication path distance | 1,000 km | 1,000 km |
| Receiving power (Ground) [7] | −90 dBm | −90 dBm |
| Receiving antenna gain (Ground) [8] | 36.5 dBi | 41.5 dBi |
| Output Parameters | | |
| Path loss | 170.51 dB | 173.42 dB |
| Min. transmitting antenna gain (Satellite) | 7.02 dBi | 4.94 dBi |

antenna, and $a_t$ and $a_r$ are the polarization vectors of the transmitting and receiving antennas, respectively [3]. The calculated link budget is summarized in Table I.

The parameters for the ground station antenna can be estimated from a commercially available ground station antenna [8] and used to calculate the link budget.

According to the link budget estimation at the maximum communication distance of 1,000 kilometer (km), the antenna must have a gain of 7.02 decibels relative to isotropic (dBi) and 4.94 dBi at 8 GHz and 11.2 GHz, respectively. Note that additional losses will be introduced by polarization mismatch, atmospheric effects during propagation, and insertion loss from the feeding, which were not taken into consideration in the link budget calculation. However, the link budget has been calculated for upper limit of the range of path distances, 433 to 1000 km, which allows for a loss margin of 7 dB.

Antenna Design and Simulation

From the link and power budget calculations, the CubeSat antenna must achieve a minimum gain of 7 dBi and 5 dBi at 8 GHz and 11.2 GHz, respectively, to cover a wide communication distance up to 1,000 km with high efficiency for efficient power management. In addition, a circularly polarized antenna is favorable for satellite wireless communication because circular polarization eliminates the adverse effects of using a linearly polarized antenna, which include a 3 decibel (dB) loss from Faraday rotation and additional losses from polarization mismatch [2, 9]. Also, wide bandwidth is favorable for the CubeSat applications. To meet these requirements, an Archimedean spiral antenna (ASA) backed by a copper cavity containing conical perturbations is disclosed. A balun is also disclosed for converting unbalanced to balanced input signals and transforming impedance from a coaxial transmission line to the a feed port of the spiral antenna element.

In what follows, example embodiments of the disclosure (and their simulation and measured performance) will be described. Those skilled in the art will also appreciate that various adaptations and modifications of the preferred and alternative embodiments described can be configured without departing from the scope and spirit of the disclosure. Therefore, it is to be understood that, within the scope of the appended claims, the disclosure may be practiced other than as specifically described.

Archimedean Spiral Antenna and Balun

Figure 2:
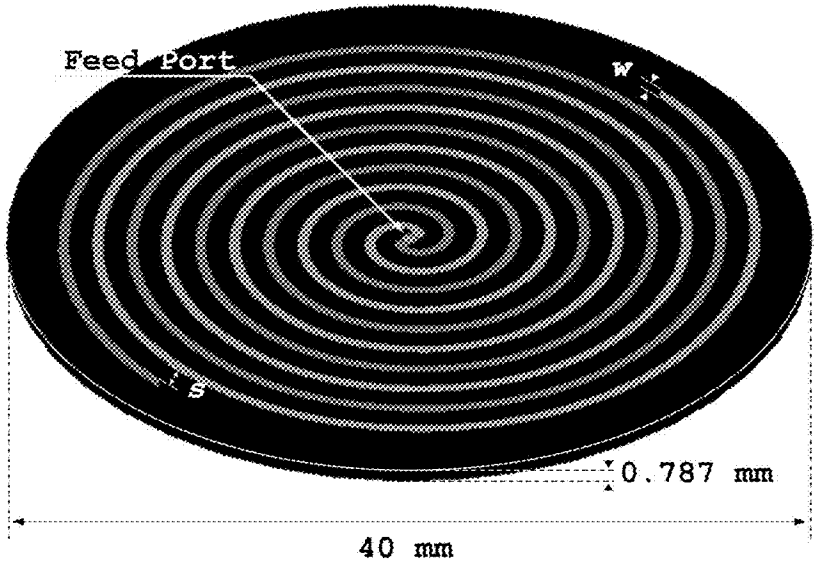
FIG. 2 depicts a top perspective view of a Archimedean spiral antenna according to an implementation of the present disclosure.

The ASA has a planar structure and characteristically wide bandwidth with respect to both circular polarization and impedance [3, 10]. An ASA consists of two conductive radiator arms (i.e., arms) with a number of turns (n) of 5, an arm width (w) of 0.7 millimeters (mm), and a spacing (s) of 1 mm. The conductive arms are disposed on a circular substrate of ROGERS DUROID™ 5880. As shown in FIG. 2, the circular substrate has a diameter of 40 mm, a thickness of 0.787 mm. The substrate of ROGERS DUROID™ 5880 has a relative dielectric constant ($\varepsilon_r$) of 2.2.

Figure 3A:
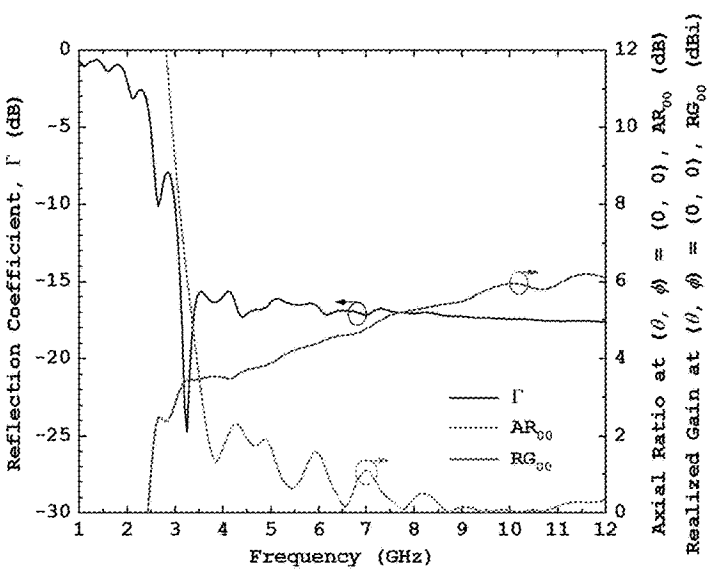
FIG. 3A is a graph showing reflection coefficients, axial ratios, and realized gain for a range of frequencies of the Archimedean spiral antenna of FIG. 2.
Figure 3B:
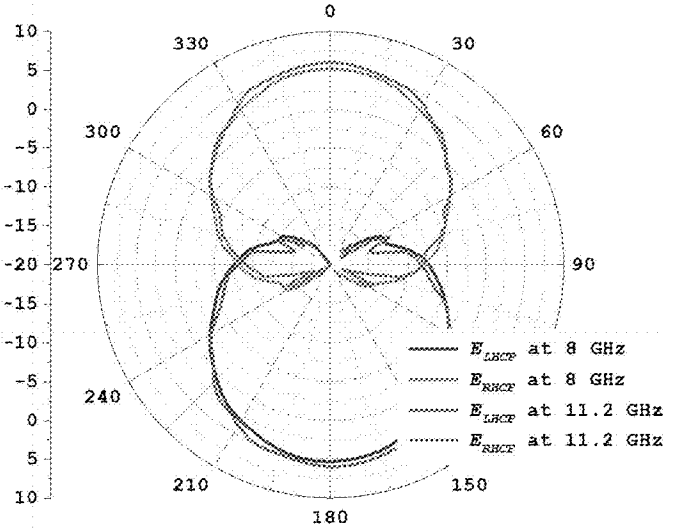
FIG. 3B is a polar plot showing the antenna pattern of the Archimedean spiral antenna of FIG. 2.

As shown in FIG. 3A, the ASA shows a good impedance matching with wide bandwidth, and low axial ratio at boresight ($AR_{00}$: <3 dB) above 3.5 GHz. Also as shown in FIG. 3A, the realized gains at boresight ($RG_{00}$) of the ASA are 5.2 dBi at 8 GHz and 6 dBi at 11.2 GHz, which do not meet the minimum required gain. In addition, the radiation pattern of the ASA in FIG. 3B is bidirectional, resulting in the loss of half of the antenna's power. Additionally, fixing the ASA directly to the face of the CubeSat would negate the desirable ASA qualities due to ground plane effects [4]. Lastly, if left unshielded, adjacent electronic systems may experience electromagnetic interference (EMI). In order to address the aforementioned issues, the ASA can be backed by a cylindrical cavity, which will be discussed in the next section.

Figure 7B:
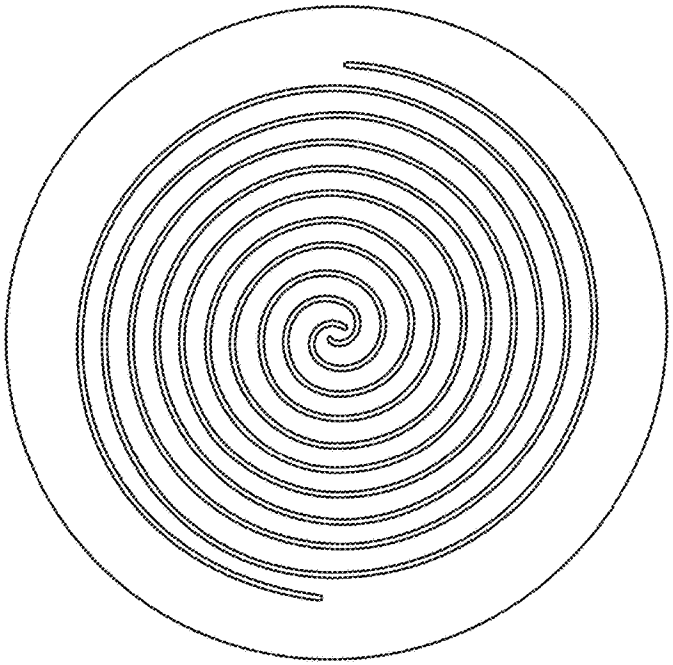
FIG. 7B is a top plan view of an antenna element according to an implementation of the present disclosure.
Figure 7A:
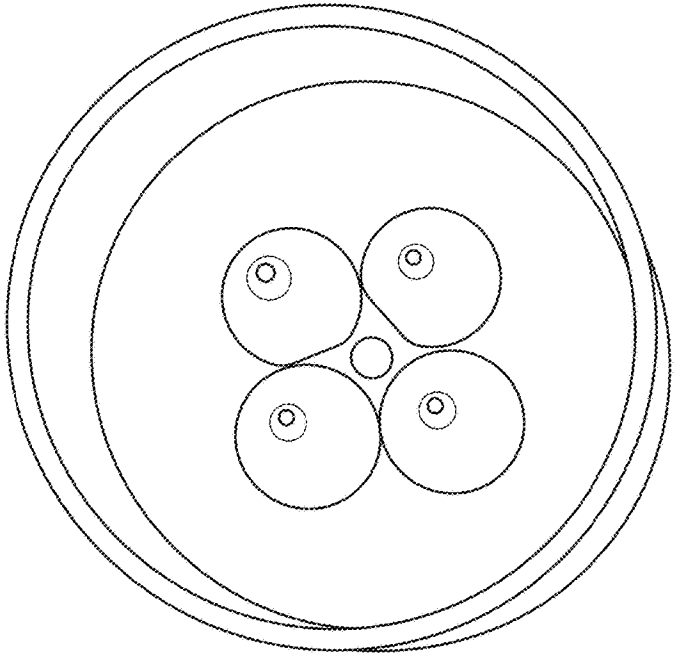
FIG. 7A is a top plan view of a cylindrical cavity having four conical perturbation elements according to an implementation of the present disclosure.
Figure 7C:
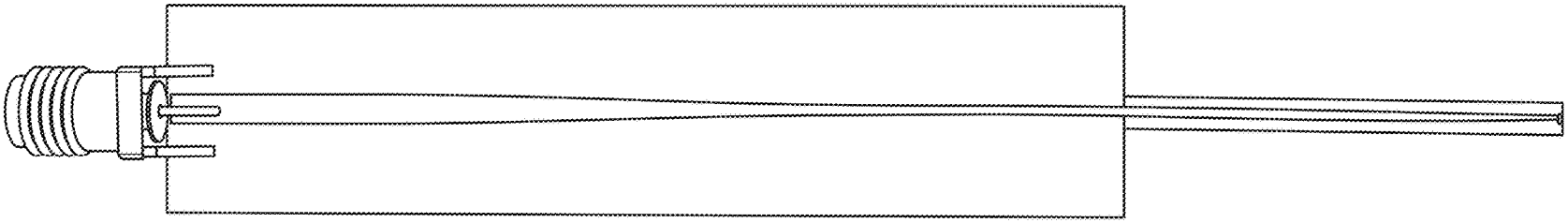
FIG. 7C is a is a top plan view of feed circuit for coupling a coaxial transmission line to a feed port of the antenna element of FIG. 7B according to an implementation of the present disclosure.

A tapered microstrip balun is used to feed ASA (see FIG. 7C). The balun uses a Klopfenstein taper [11-13] to transform the impedance from 50 ohms (Ω) to 150Ω and convert an unbalanced signal to a balanced signal. Simulated balun performance shows a wide operation frequency range with low insertion loss (IL=−20 log|S21|).

Cylindrical Cavity with Perturbation Elements

Figure 4A:
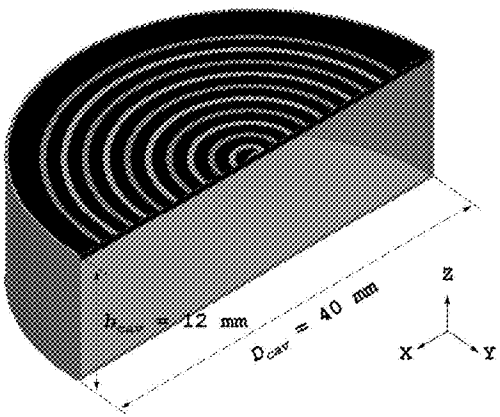
Fig. 4A (PRIOR ART)
FIG. 4A depicts a perspective section view of a cavity backed Archimedean spiral antenna without perturbation elements according to prior art.
Figure 4B:
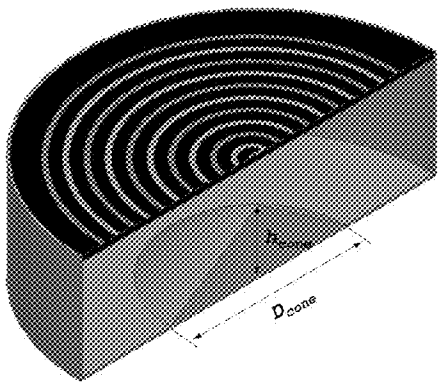
FIG. 4B depicts a perspective section view of a cavity backed spiral antenna with one perturbation element according to an implementation of the present disclosure.
Figure 4C:
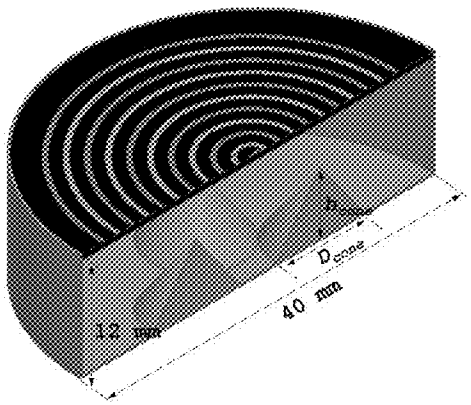
FIG. 4C depicts a perspective section view of a cavity backed spiral antenna with a plurality of perturbation elements according to an implementation of the present disclosure.

In order to alleviate issues for the ASA discussed in the previous section, a backing cavity was designed to improve realized gain (RG) and reflect the back radiation. Three backing cavities were designed and simulated with the optimized ASA. As shown in FIGS. 4A, 4B, and 4C, the variations include a conventional cylindrical back cavity with no perturbation elements (i.e., NP cavity) (FIG. 4A), a cavity with a center single conical perturbation element (i.e., SCP cavity) (FIG. 4B), and a cavity with quadruple (4) conical perturbation elements (QCP cavity) (FIG. 4C).

A conventional cavity-backed Archimedean spiral antenna (CBASA) with no perturbation (NP) elements is shown in FIG. 4A, while FIGS. 4B and 4C illustrate the CBASA of FIG. 4A with a single conical perturbation (SCP) element and quadruple conical perturbation (QCP) elements respectively. As show, a cavity height ($h_{cav}$) of 12 mm and a diameter ($D_{cav}$) of 40 mm are chosen for each CBASA variation. The conical perturbation element diameters ($D_{cone}$) of 20 mm and 8 mm are chosen for the SCP and QCP cavities, respectively, and a conical perturbation element height ($h_{cone}$) of 7 mm is chosen for both SCP and QCP cavities.

Figure 5B:
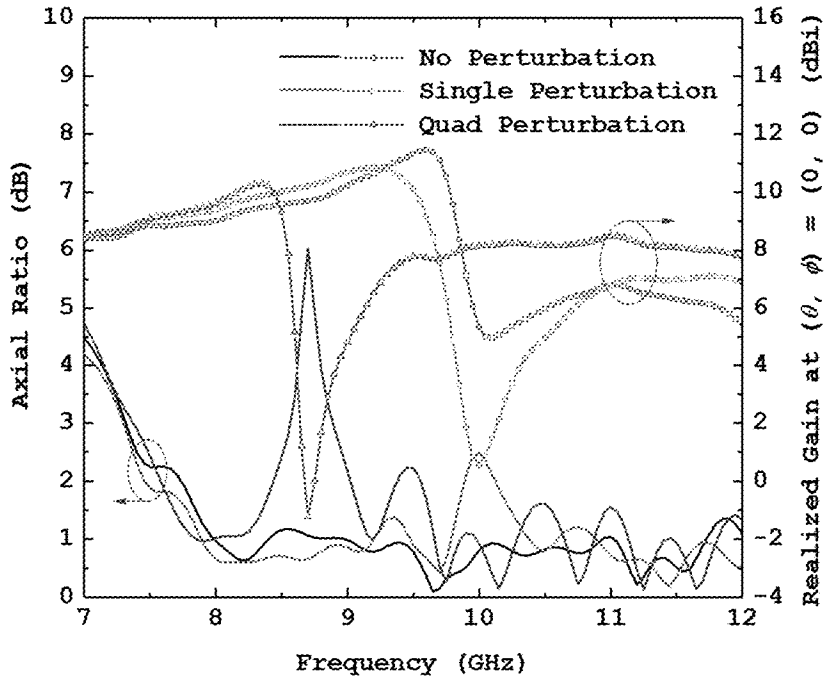
FIG. 5B is a graph showing axial ratio (left vertical axis) and realized gain (right vertical axis) for a range of frequencies and for the antennas with no perturbation elements, one perturbation element, and four perturbation elements.
Figure 5A:
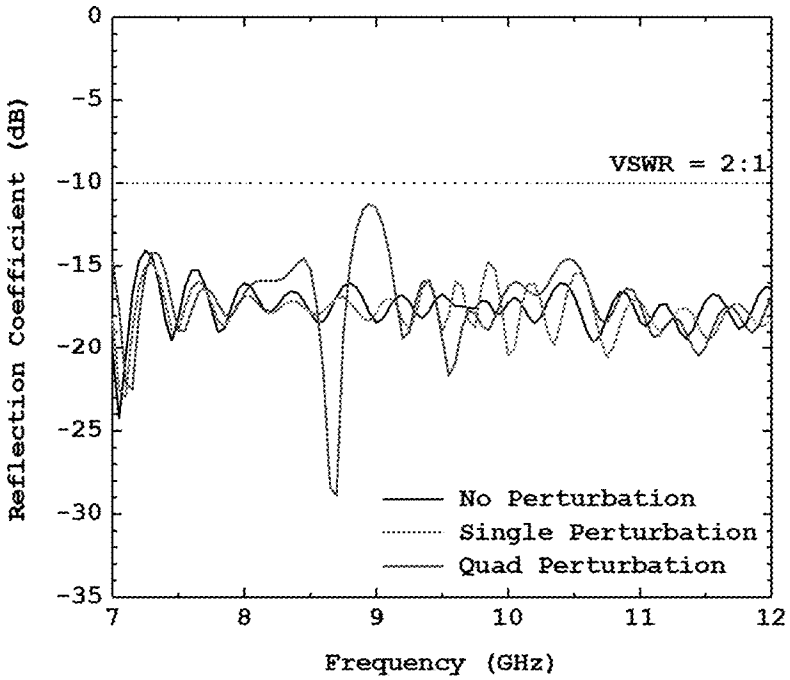
FIG. 5A is a graph showing simulated reflection coefficient versus frequency for no perturbation elements, one perturbation element, and four perturbation elements as compared to a requirement (dotted line).

All three variations of cavities (i.e., NP, SCP, and QCP) have good frequency independent characteristics when placed behind the ASA in simulation. FIGS. 5A-5B show the simulated antenna performance of CBASA with NP, SCP, and QCP. As shown in FIG. 5A, all three antennas show a good impedance matching (reflection coefficient (Γ)<−10 dB) over the frequency range from 7 GHz to 12 GHz, indicating frequency independent characteristics. FIG. 5B shows antenna radiation performance. The CBASA with NP cavity has a large drop in realized gain at boresight ($RG_{00}$) at 9.5 GHz, which persists past 12 GHz. This disruption of wideband behavior is caused by excitation of cavity modes [19]. To improve wideband characteristics, absorbing materials have been inserted into cavities [14, 20], which results in reduction of the antenna gain [19, 21]. Alternatively, to maintain antenna gain, perturbations have been added to backing cavities to reduce gain variations [19]. By introducing SCP, the $RG_{00}$ drop still appears at 9.5 GHz. However, the $RG_{00}$ was restored to about 7 dBi above 11 GHz. By employing QCP cavity, the $RG_{00}$ drop frequency shifts to a lower frequency. Furthermore, the $RG_{00}$ for the cavity backed ASA with QCP cavity (CBASA-QCP) is nearly restored up to 7 dBi above 9.2 GHz. However, the axial ratio at boresight ($AR_{00}$) for the CBASA-QCP shows a peak at the dip of $RG_{00}$ (8.7 GHz), which limits the operational bandwidth.

Figure 6:
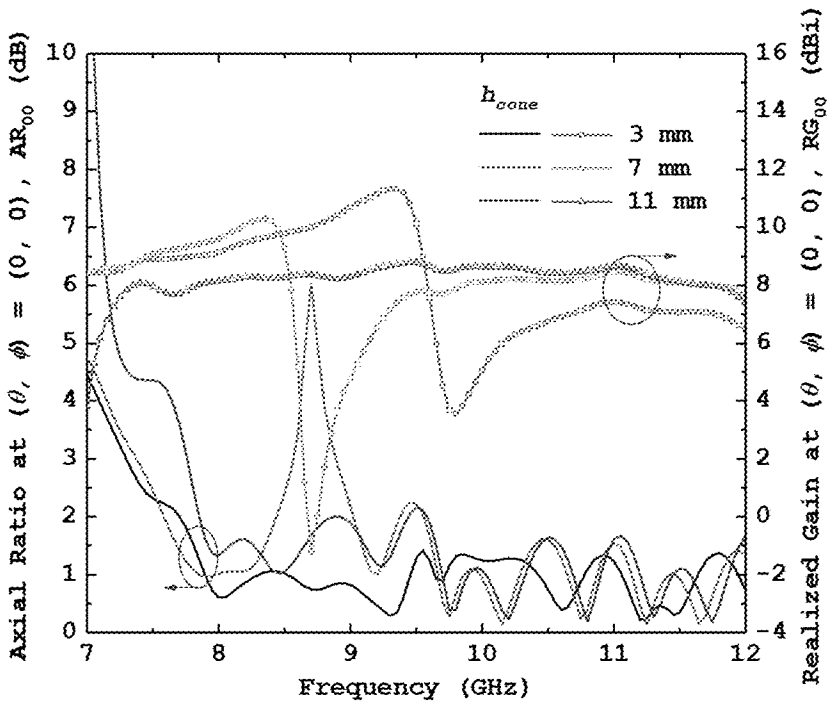
FIG. 6 is a graph showing axial ratio (left vertical axis) and realized gain (right vertical axis) for a range of frequencies and for different perturbation element heights.

To address the above issues, the QCP cavity design was optimized by varying $h_{cone}$. It is clearly observed that the $RG_{00}$ drop shifted to a lower frequency as $h_{cone}$ increased from 3 mm to 11 mm, as shown in FIG. 6. Also, the unwanted peak in $AR_{00}$ is shifted to a lower frequency. Accordingly, the $h_{cone}$ of 11 mm and diameter of 8 mm resulted in the $AR_{00}$ below 3 dB and $RG_{00}$ above 7.5 dBi for the entire range from 8 GHz to 12 GHz, which allows wide operation bandwidth. The design parameters used in a fabrication of the QCP cavity was as follows: $h_{cone}$ of 11 mm and $D_{cone}$ of 8 mm.

Antenna Fabrication and Measurement

Figure 8:
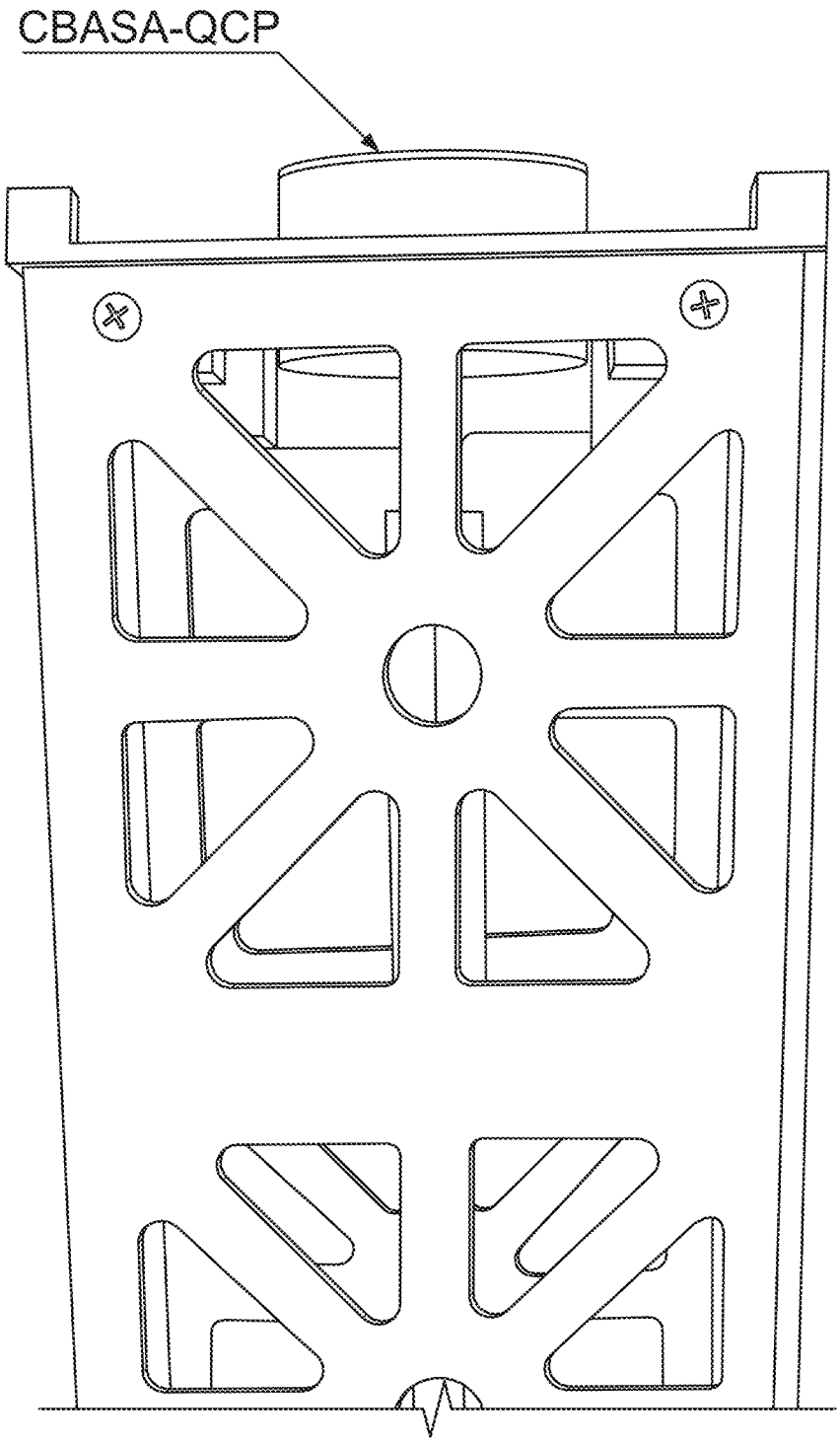
FIG. 8 is a side view a cavity-backed Archimedean spiral antenna with quadruple conical perturbations (CBASA-QCP) mounted on a 3U cube satellite (CubeSat) frame according to an implementation of the present disclosure.

The ASA and balun may be milled on Rogers Duroid 5880 using an LPKF S62™ Milling Machine. The backing cavities can be fabricated from copper C101 oxygen free stock. The balun extends into a parallel plate transmission line, which passes through a 2.5 mm hole in the bottom of the cavity to connect to the fabricated spiral antenna. FIGS. 7A-7C show the fabricated QCP cavity (FIG. 7A), ASA (FIG. 7B), and a tapered microstrip balun (FIG. 7C). Also, a side view of the fabricated antenna mounted on the small (10 cm×10 cm) face of the 3U CubeSat is shown in FIG. 8.

The tapered microstrip balun feeds the CBASA and converts unbalanced input signals to balanced input signals. The balun also transforms the impedance from 50 ohms (Ω) to 150Ω. When assembled, the tapered microstrip balun passes through a 2.5 mm hole in the bottom of the QCP cavity to connect to the ASA.

To test the balun, a double ended balun was fabricated which transforms the impedance from 50 ohms (Ω) to 150Ω then back to 50Ω. A Vector Network Analyzer (VNA: AGILENT™ N5320A) was used to measure the $S_{11}$ and $S_{21}$. The fabricated balun showed a low reflection coefficient (Γ) and insertion loss (IL) at X-band. However, measured behaviors of the Γ and IL were slightly degraded at high frequencies (f>10 GHz), which was different from the simulated results. This small discrepancy occurred due to fabrication errors.

Figures 9A, 9B, 9C:
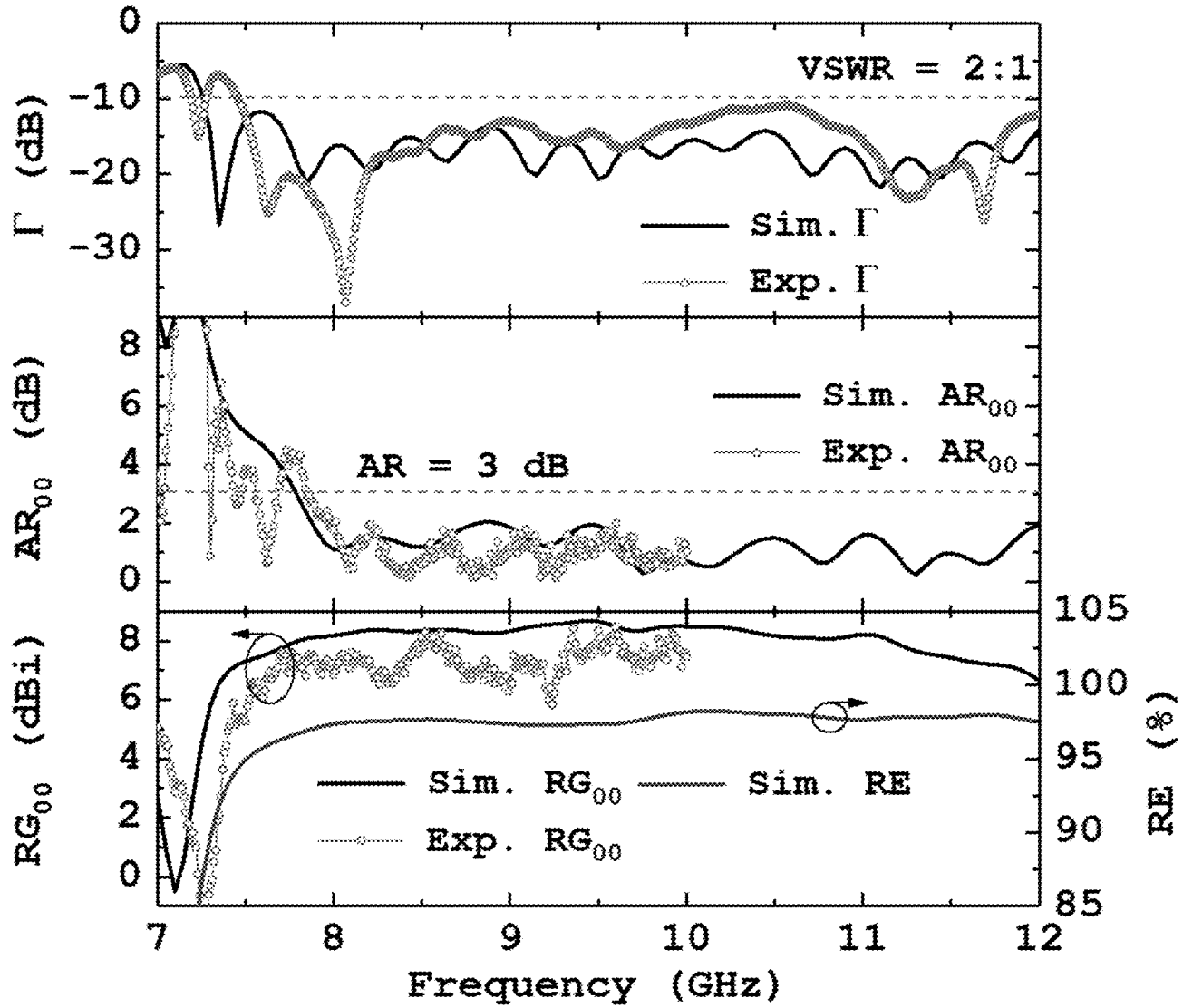
FIG. 9A is a graph of simulated and measured reflection coefficients of the CBASA-QCP for a range of frequencies according to an implementation of the present disclosure.
FIG. 9B is a graph of simulated and measured axial ratios of the CBASA-QCP for a range of frequencies according to an implementation of the present disclosure.
FIG. 9C is a graph of simulated and measured realized gain and radiation efficiency of the CBASA-QCP for a range of frequencies according to an implementation of the present disclosure.

The Γ of the fabricated CBASA-QCP is shown in FIG. 9A. Sufficient impedance matching was achieved from 7.5 GHz to 12 GHz, which can include X-bands and Ku-bands. However, a slight difference between the measured and simulated Γ is observed due to imperfections in fabrication of the balun. The radiation characteristics of the fabricated antenna, which include the frequency dependent $RG_{00}$ and the radiation pattern, were measured in the frequency range from 7 GHz to 10 GHz using the Anechoic Chamber (e.g., RAYMOND EMC QUIETBOX AVS™ 700). The measured $AR_{00}$ (FIG. 9B) and $RG_{00}$ (FIG. 9C) follow the trends of the simulated $AR_{00}$ (FIG. 9B) and $RG_{00}$ (FIG. 9C). At 8 GHz, the measured $AR_{00}$ is below 3 dB and the $RG_{00}$ is 7 dBi, which meet the requirements of the specifications of the CubeSat antenna. Moreover, the simulated RE of the antenna is higher than 95% in the frequency above 7.5 GHz (FIG. 9C), which is essential for efficient power management.

Figure 10B:
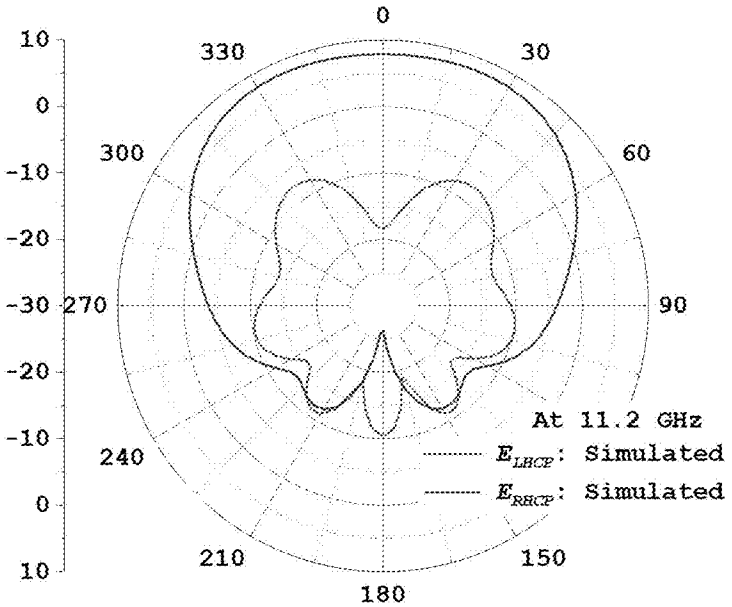
FIG. 10B is a polar plot showing the antenna pattern of the CBASA-QCP at 11.2 GHz according to an implementation of the present disclosure.
Figure 10A:
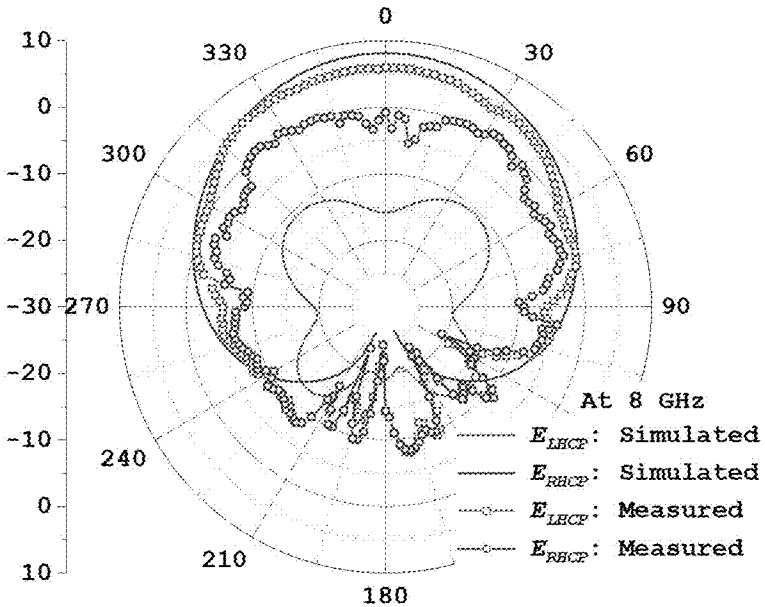
FIG. 10A is a polar plot showing the antenna pattern of the CBASA-QCP at 8 gigahertz (GHz) according to an implementation of the present disclosure.

In FIGS. 10A and 10B, the simulated radiation patterns at 8 GHz (FIG. 10A) and 11.2 GHz (FIG. 10B) reveal the effect of the backing cavity as it redirects the back-lobe and increases the $RG_{00}$. This behavior is confirmed by the measured radiation pattern at 8 GHz. It is also noted that the simulated (co-pol: $E_{RHCP}$) and measured (co-pol: $E_{LHCP}$) polarizations are not matched. This is because the top side of the ASA of the fabricated CBASA-QCP, which has the spiral radiator, was flipped, as compared to that of the simulated CBASA-QCP, in order to be fed by the balun.

Figure 11:
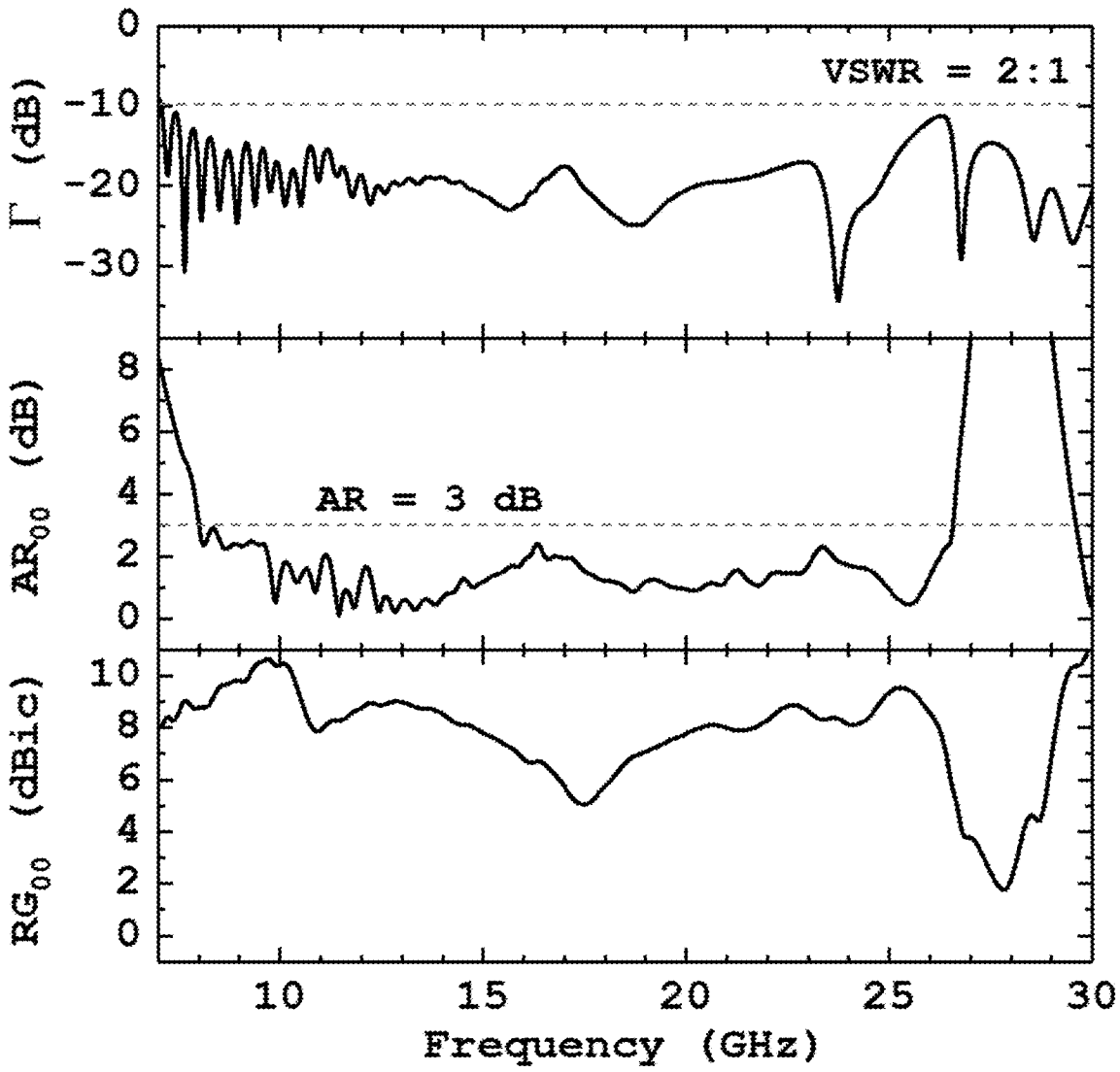
FIG. 11 are plots showing the simulated frequency dependent reflection coefficient (Γ), axial ratio at boresight ($AR_{00}$), and realized gain at boresight ($RG_{00}$) for an optimized CBASA-QCP according to an embodiment of the present disclosure.

Further improvement in −10-dB impedance bandwidth, 3-dB AR bandwidth, and 3-dB gain bandwidth was achieved by optimizing $H_{cav}$, $H_{cone}$, and $D_{cone}$. FIG. 11 shows the simulated antenna performance of optimized CBASA-QCP with $H_{cav}$ of 6 mm, $H_{cone}$ of 2 mm, and $D_{cone}$ of 8 mm. An optimized CBASA-QCP shows a −10-dB impedance bandwidth of 23 GHz (7-30 GHz), 3-dB AR bandwidth of 18.5 GHz (8-26.5 GHz), and 3-dB gain bandwidth of 8 GHz (7-15 GHz).

Antenna performance of the optimized CBASA-QCP was compared with the reported wideband circularly polarized antennas [15-18] and is summarized in Table II.

TABLE II

ANTENNA PERFORMANCE COMPARISON OF WIDEBAND CIRCULARLY POLARIZED ANTENNAS.

| | Area | −10-dB Impedance Bandwidth | 3-dB Axial Ratio Bandwidth | 3-dB Gain Bandwidth | Peak Gain |
|---|---|---|---|---|---|
| [15] | $0.27\ \lambda_L^2$ ($0.52\ \lambda_L \times 0.52\ \lambda_L$) | 45.6% | 23.4% | >36% | 7.6 dBic |
| [16] | — | 66.3% | 44.7% | 48.2% | 6 dBic |
| [17] | $1.1\ \lambda_L^2$ ($1.05\ \lambda_L \times 1.05\ \lambda_L$) | 92.1% | 54.5% | 50% | 9.9 dBic |
| [18] | $1.934\ \lambda_L^2$ ($1.29\ \lambda_L \times 1.5\ \lambda_L$) | 64.3% | 54.3% | >66.7% | 10.84 dBic |

TABLE II-continued

ANTENNA PERFORMANCE COMPARISON OF WIDEBAND CIRCULARLY POLARIZED ANTENNAS.

| | Area | −10-dB Impedance Bandwidth | 3-dB Axial Ratio Bandwidth | 3-dB Gain Bandwidth | Peak Gain |
|---|---|---|---|---|---|
| Invented CBASA-QCP | 0.89 $\lambda_L^2$ (D = 1.07 $\lambda_L$) | >124.3% (7-30 GHz) | 107.2% (8-26.5 GHz) | 72% (7-15 GHz)/ 28.6% (19.7-26.5 GHz) | 10.7 dBic |

$\lambda_L$ is the air wavelength at lowest frequency.

The disclosed CBASA-QCP has a −10-dB impedance bandwidth of 124.3%, 3-dB AR bandwidth of 107.2%, and 3-dB gain bandwidth of 72% and 28.6% with high peak gain of 10.7 dBic. These are much higher than those of recently developed antennas [15-18]. Accordingly, the disclosed CBASA-QCP can simultaneously cover operation frequencies of X-band (8-12 GHz), Ku-band (12-18 GHz), and K-band (18-27 GHz) with a small area of $0.89\lambda_L^2$, where $\lambda_L$ is the free space wavelength at the lowest frequency. The CBASA-QCP is suitable for small satellite applications.

Antenna Placement on the 3U CubeSat

Figure 12A:
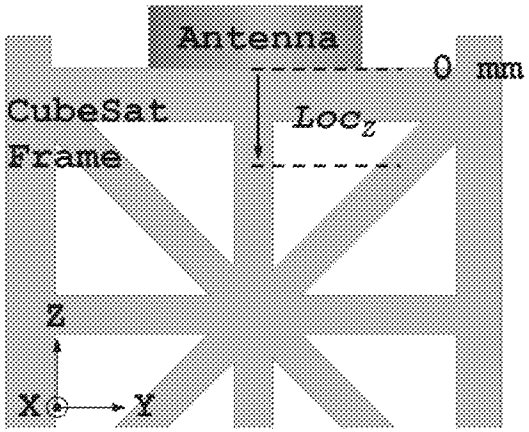
FIG. 12A is a side view of the CBASA-QCP illustrating a range of antenna locations with respect to the frame according to implementations of the present disclosure.
Figure 12B:
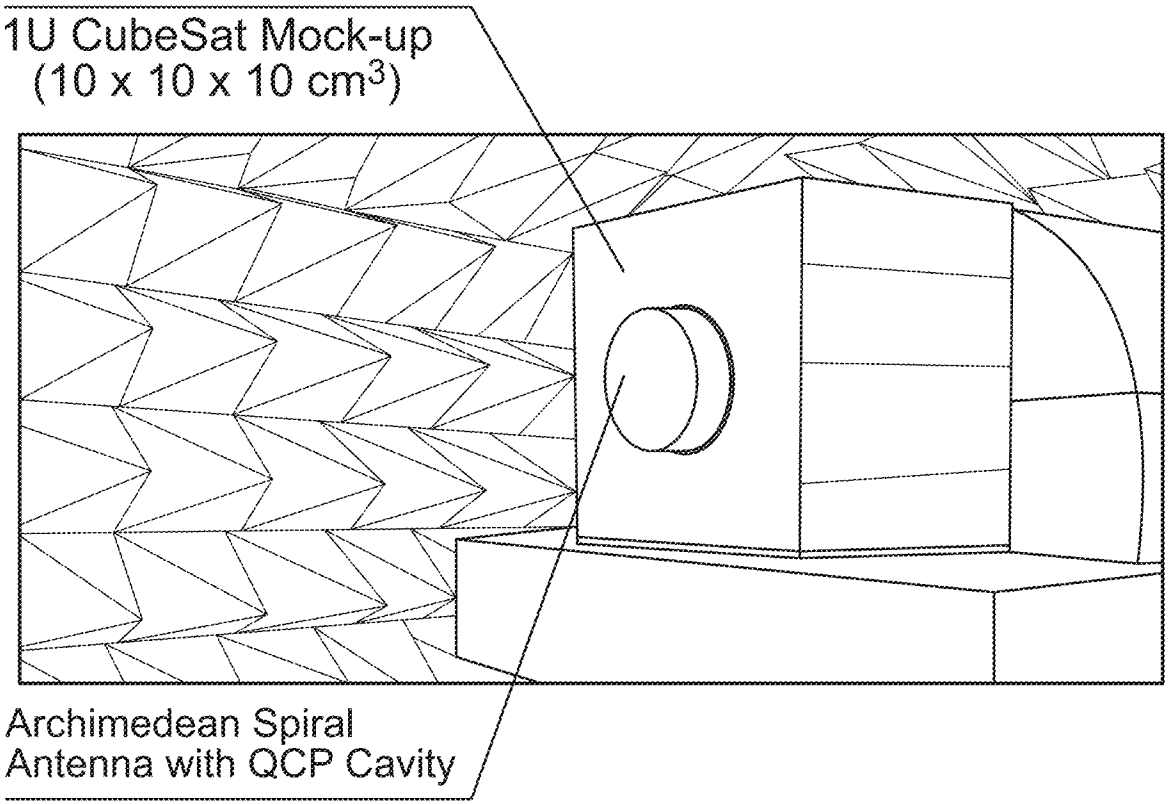
FIG. 12B is a perspective view of a 1U CubeSat mock-up for testing the CBASA-QCP according to an implementation of the present disclosure.
Figure 13B:
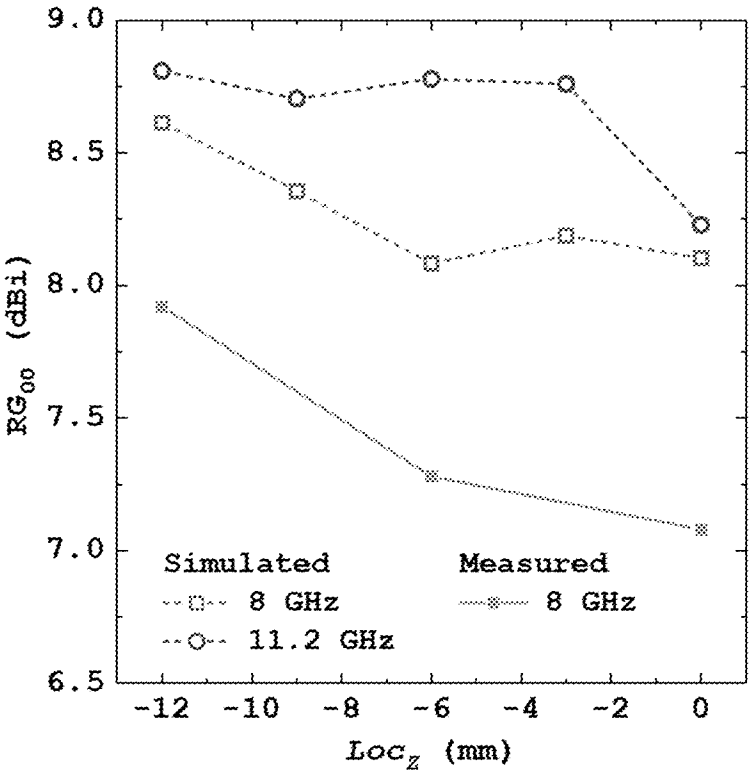
FIG. 13B is a graph of simulated and measured realized gain of the CBASA-QCP for a range of frequencies at three antenna locations.
Figure 13A:
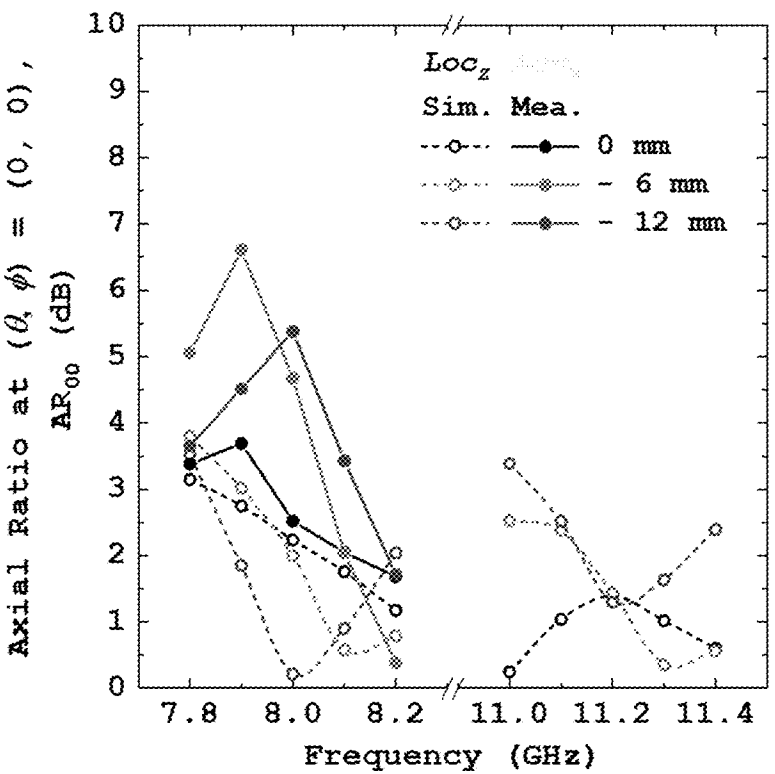
FIG. 13A is a graph of simulated and measured axial ratios of the CBASA-QCP for a range of frequencies at three antenna locations.

Simulation and measurement were performed to investigate the effect of an aluminum (Al) body of a 3U CubeSat on antenna performance. Accordingly, the optimal placement of the antenna by varying the location of the cavity ($Loc_Z$: distance between the bottom of the antenna cavity and the face of the CubeSat) was determined as shown in FIG. 12A. For measurement, a 1U CubeSat mock-up (dimension: 10 cm×10 cm×10 cm) was made, and the fabricated antenna was loaded onto the mock-up, which is shown in FIG. 12B (b). FIGS. 13A and 13B show the simulated and measured $AR_{00}$ and $RG_{00}$ of the CBASA-QCP with different $Loc_Z$. The simulated $AR_{00}$ is close to 3 dB at 8 and 11.2 GHz for all $Loc_Z$, although the measured data reveals that it is slightly higher than 3 dB for $Loc_Z$ of −6 and −12 mm. Moreover, decreasing $Loc_Z$ from 0 to −12 mm increases the measured RG00 from 7.1 to 7.9 dBi. Therefore, it is confirmed that the CBASA-QCP can be loaded onto the CubeSat with good radiation performance.

CONCLUSION

An antenna with circular polarization, high radiation efficiency (RE), and high gain of 7.02 dBi and 7.9 dBi at 8 GHz and 11.2 GHz, respectively is disclosed. The cavity design allows for a low axial ratio (<3 dB) and high peak realized gain (>6.7 dBic) at boresight in the frequency range from 8 GHz to 12 GHz. A uni-directional radiation pattern was achieved with the invented cavity-backed Archimedean spiral antenna with quadruple conical perturbations (CBASA-QCP). Therefore, electromagnetic interference with internal electronics can be reduced.

The antenna meets the requirements of circular polarization, high radiation efficiency (RE), and high gain (i.e., 7.02 dBi and 4.94 dBi at 8 GHz and 11.2 GHz, respectively), which matches the determined link and power budgets for a calculated link scenario.

The antenna is a cavity-backed Archimedean spiral antenna with quadruple conical perturbations (CBASA-QCP). The antenna shows an axial ratio at boresight of less than 3 dB for most of the frequency range from 8 GHz to 12 GHz. Also, the antenna has a uni-directional radiation pattern at 8 GHz. The realized gain of the antenna at boresight ($RG_{00}$) is stabilized over the whole frequency range by introducing a QCP cavity. The simulated and measured $RG_{00}$ of the antenna are 8.2 dBi and 6.9 dBi at 8 GHz, and the simulated $RG_{00}$ of the antenna is 7.9 dBi at 11.2 GHz. Therefore, the requirements of the link budget are met. In addition, the simulated RE is stabilized at 95% from 7.5 GHz to 12 GHz. Lastly, the antenna is unaffected by mounting location on the CubeSat mock-up. Therefore, the developed CBASA-QCP is suitable for satellite-ground wireless communication, especially for small satellites.

The antenna is further improved in −10-dB impedance bandwidth (>124.3%: 7-30 GHz), 3 dB-dB axial ratio bandwidth (107.2%: 8-26.5 GHz), and 3-dB gain bandwidth (72%: 7-15 GHz and 28.6%: 19.7-26.5 GHz) by optimizing the cavity with quadruple conical perturbations (QCP cavity).

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

REFERENCES

[1] M. Swartwout, "The first one hundred CubeSats: a statistical look," *J. Small Satell.*, vol. 2, pp. 213-233, 2014.

[2] F. E. Tubbal, R. Raad, and K. W. Chin, "A Survey and Study of Planar Antennas for Pico-Satellites," *IEEE Access*, vol. 3, pp. 2590-2612, 2015.

[3] S. Gao, Q. Luo, and F. Zhu, "Introduction to Circularly Polarized Antennas" in *Circularly Polarized Antennas*, United Kingdom: John Wiley & Sons Ltd, 2014, pp 1-25.

[4] General Mission Analysis Tool [Open Source Software]. Available: http://gmat.gsfc.nasa.gov

[5] R. R. Bate, D. D. Mueller, and J. E. White, Fundamentals of Astrodynamics. New York: Dover Publications, 1971, pp. 33-34.

[6] T. Soler and D. W. Eisemann, "Determination of Look Angles to Geostationary Communication Satellites." *J. Surveying Engineering*, vol. 120, no. 3, pp. 115-127, August 1994.

[7] A. Atayero, M. K. Luka, and A. A. Alatishe, "Satellite Link Design: A Tutorial," *Int. J. of Elect. and Comput. Sci.*, vol. 11, no. 4, August 2011.

[8] "GATR 1.2 Meter High-bandwidth, Backpackable Antenna." Internet: http://www.gatr.com/products/1-2 antenna-system, 2016 [Apr. 20, 2017].

[9] C. A. Balanis, *Antenna Theory: Analysis and Design,* 3rd edition. Hoboken, N.J.: John Wiley & Sons, 2005, pp. 94-96.

[10] H. Nakano, T. Igarashi, H. Oyanagi, Y. Iitsuka, and J. Yamauchi, "Unbalanced-Mode Spiral Antenna Backed by an Extremely Shallow Cavity," *IEEE Trans. Antennas Propag.*, vol. 57, no. 6, pp. 1625-1633, June 2009.

[11] R. W. Klopfenstein. "A Transmission Line Taper of Improved Design." *Proc. IRE*, vol. 44, no. 1, pp. 31-35, 1956.

[12] D. M. Pozar, "Impedance Matching and Tuning" in Microwave Engineering, 4th ed., Danvers, Mass.: John Wiley & Sons, Inc., 2012, p. 265.

[13] S. A. P. Rizvi and R. A. A. Khan, ""Klopfenstein tapered 2-18 GHz microstrip balun," in *Proc. IBCAST*, Islamabad, Pakistan, 2012, pp. 359-362.

[14] E. D. Caswell, "Design and Analysis of Star Spiral with Application to Wideband Arrays with Variable Element Sizes." Ph.D. dissertation, Dept. Elect. Eng., Virginia Polytechnic Institute and State University, Blacksburg, Va., USA, 2001.

[15] S. X. Ta and I. Park, "Low-Profile Broadband Circularly Polarized Patch Antenna Using Metasurface," IEEE Transactions on Antennas and Propagation, vol. 63, no. 12, pp. 5929-5934, 2015.

[16] D. Feng, H. Zhai, L. Xi, S. Yang, K. Zhang, and D. Yang, "A Broadband Low-Profile Circular Polarized Antenna on an AMC Reflector," IEEE Antennas and Wireless Propagation Letters, 2017, in press.

[17] Y.-J. Hu, W.-P. Ding, W-M. Ni, and W.-Q. Cao, "Broadband Circularly Polarized Cavity-Backed Slot Antenna Array With Four Linearly Polarized Disks Located in a Single Circular Slot," IEEE Antennas and Wireless Propagation Letters, vol. 11, pp. 496-499, 2012.

[18] A. Siahcheshm, J. Nourinia, Ch. Ghobadi, M. Karamirad, and B. Mohammadi, "A Broadband Circularly Polarized Cavity-backed Archimedean Spiral Array Antenna for C-band Applications," International Journal of Electronics and Communications, vol. 81, pp. 218-226, 2017.

[19] N. Jastram and D. S. Filipovic, "Design of Cavity Backed 15:1 Bandwidth Two Arm Spiral Helix Antenna," in *IEEE/ACES International Conference on Wireless Information Technology and Systems and Applied Computational Electromagnetics*, Honolulu, Hi., 2016, pp. 1-2.

[20] H. Nakano, H. Oyanagi, and J. Yamauchi, "Extremely Low-Profile Wideband Spiral Antenna with Absorbing Material," in 3$^{rd}$ *European Conference on Antennas and Propagation*, Berlin, 2009, pp. 1029-1032.

[21] F. Ding, F. Zhang, and Y. Zhang, "The Broadband Composite Structure Spiral Antenna with a Ladder-Shaped Backed-Cavity," 2011 4$^{th}$ *IEEE International Symposium on Microwave*, Antenna, Propagation and EMC Technologies for Wireless Communications, Beijing, 2011, pp. 120-123.

The invention claimed is:

1. An antenna, comprising an antenna element comprising two conductive arms disposed on a circular substrate, wherein each conductive arm begins at one side of a feed port and traces a spiral for a plurality of revolutions, wherein each arm has an arm width (w) of 0.7 millimeters (mm), and a spacing (s) of 1 mm;

a cylindrical cavity comprising a cavity base and a cavity wall, wherein the cavity wall defines an opening that substantially matches an outer diameter of the circular substrate, and wherein the cylindrical cavity is positioned behind the antenna element so that the substrate covers the opening formed by the cavity wall to form an airspace enclosed by the circular substrate, cavity wall, and cavity base; and a plurality of conical perturbation elements disposed or formed on the cavity base within a diameter defined by an outermost boundary of the spiral of the conductive arms, wherein each perturbation element extends from the cavity base in an axial direction toward the circular substrate, each perturbation element having has an element base that is flush with the cavity base, said element base having a diameter and an element top at a height above the cavity base, and wherein the height of each element top is in the airspace between the cavity base and the circular substrate, wherein the cavity has a height ($H_{cav}$), each conical perturbation element has a base diameter ($D_{cone}$) and a height ($H_{cone}$), wherein $H_{cav}$, $D_{cone}$ and $H_{cone}$ are configured such that the antenna has a −10-dB impedance bandwidth a 124.3% or greater at 7-30 GHz measured at the feed port, a 3 dB axial ratio bandwidth of 107.2% at 8-26.5 GHz measured at the feed port, and a 3-dB gain bandwidth of 72% at 7-15 GHz and 28.6% at 19.7-26.5 GHz measured at the feed port, and wherein said cavity base defines a hole, said hole for connecting a balun with the feed port, wherein said hole does not interfere with any one of the plurality of conical perturbation elements.

2. The antenna according to claim 1, wherein the spiral is an Archimedean spiral and the plurality of revolutions is five.

3. The antenna according to claim 1, wherein the −10-dB impedance bandwidth measured at the feed port of the antenna depends at least in part on a size, a number and/or an arrangement of the perturbation elements.

4. The antenna according to claim 1, wherein the 3 dB axial ratio bandwidth measured at the feed port of the antenna depends at least in part on a size, a number and/or an arrangement of the perturbation elements.

5. The antenna according to claim 1, wherein the 3-dB gain bandwidth measured at the feed port of the antenna depends at least in part on a size, a number and/or an arrangement of the perturbation elements.

6. The antenna according to claim 1, wherein each conductive arm is a conducting polymer, metal, or metal alloy.

7. The antenna according to claim 1, wherein the plurality of conical perturbation elements comprise quadruple conical perturbations.

8. The antenna according to claim 7, wherein $H_{cone}$ of each of the quadruple conical perturbations is 11 mm and $D_{cone}$ of each of the quadruple conical perturbations is 8 mm.

9. The antenna according to claim 8, wherein the antenna has an axial ratio (AR) below 3 dB and a realized gain (RG) above 7.5 dBi for a frequency range from 8 GHz to 12 GHz.

10. The antenna according to claim 1, wherein the cavity is comprised of copper.

* * * * *